United States Patent [19]

Littwin

[11] 4,328,444

[45] May 4, 1982

[54] GAS DISCHARGE DISPLAY DEVICE WITH A LAMELLAR LATTICE IN THE GAS DISCHARGE SPACE

[75] Inventor: Burkhard Littwin, Hohenschaeftlarn, Fed. Rep. of Germany

[73] Assignee: Siemens Aktiengesellschaft, Berlin & Munich, Fed. Rep. of Germany

[21] Appl. No.: 158,119

[22] Filed: Jun. 10, 1980

[30] Foreign Application Priority Data

Jun. 29, 1979 [DE] Fed. Rep. of Germany ..... 2926393

[51] Int. Cl.[3] ..... H01J 1/52; H01J 1/54

[52] U.S. Cl. ..... 313/492; 313/217; 315/169.4

[58] Field of Search ..... 313/492, 484, 485, 491, 313/422, 217

[56] References Cited

U.S. PATENT DOCUMENTS

| | | | |
|---|---|---|---|
| 3,148,304 | 9/1964 | Veith et al. | 313/422 X |
| 3,852,634 | 12/1974 | Sulles | 313/422 |
| 3,956,667 | 5/1976 | Veith | 313/217 |
| 4,066,929 | 1/1978 | Okamoto et al. | 313/217 X |
| 4,130,778 | 12/1978 | Branston | 313/326 X |

FOREIGN PATENT DOCUMENTS

| | | |
|---|---|---|
| 2412869 | 2/1975 | Fed. Rep. of Germany . |
| 2601925 | 7/1976 | Fed. Rep. of Germany . |
| 2643915 | 3/1978 | Fed. Rep. of Germany . |

*Primary Examiner*—Robert Segal

*Attorney, Agent, or Firm*—Hill, Van Santen, Steadman, Chiara & Simpson

[57] ABSTRACT

A gas discharge panel which has a gas discharge space formed by a control plate and a cathode on a back plate and a post acceleration space formed between the control plate and the front plate with a screen and anode which control plate has perforations, and row and column conductors characterized by an improvement of providing a lamellar lattice structure comprising a plurality of strips of material in the space between the cathode and the control plate to obstruct the direct passage of metal ions, photons, and electrons between the cathode and the control plate.

14 Claims, 5 Drawing Figures

GAS DISCHARGE DISPLAY DEVICE WITH A LAMELLAR LATTICE IN THE GAS DISCHARGE SPACE

BACKGROUND OF THE INVENTION

The present invention is directed to a gas discharge display device which has a front plate with a luminescent screen and an anode layer connected to a back plate having one or more cathodes mutually insulated from one another to form a gas filled cavity receiving a control plate which divides the cavity into a gas discharge space and a post acceleration space. The control plate has parallel extending column conductors on one surface, and parallel extending row conductors on the opposite surface to form a matrix of intersecting points and the plate has a perforation in each of the points.

A gas discharge display device with a cathode, which consists of cathode strips that lie parallel to one another and are insulated from one another so that they may be separately actuated or energized, is disclosed in U.S. Pat. No. 4,130,778, which was based on German O.S. 26 43 915. A subdivision of the cathode and individual cathode strips insulated from one another is an improvement over a plate cathode which was disclosed in U.S. Pat. No. 3,956,667, which was based on German application 24 12 869 and is employed for the image reproduction in so called flat picture screens or respectively, gas discharge displays.

These display devices function according to the principal of spatial separation of electron generation and electron acceleration. The tube or envelope, which is employed for that purpose, is divided into two chambers which are connected to one another via a control plate having perforations at the point of intersection of its conductors which are arranged in lines or rows and columns with the line or row of parallel conductors on one side extending perpendicular to the parallel columns on the other surface. The chamber or space between the cathode, which is preferably on the back plate of the envelope, and the strip shape auxillary anodes, which form either a line or row of the conductor matrix of the control plate coact to form the gas discharge space. The other chamber or space is a post acceleration space, which is formed between the plane of the column conductors on the control plate and plate anode which represents a luminescent screen electrode. A wedge-shaped gas discharge between the cathode and the auxillary anodes over the entire line length is produced by driving one of the auxillary anodes. Given a simultaneous drive of one of the strip-shaped control electrodes serving as the matrix columns, plasma electrons generated in the gas discharge are drawn through the opening at the point of intersection of the row and column into a post acceleration space and are accelerated toward the anode on the front surface or plate of the device. A point of light then occurs at the impact location on the luminescent substance layer which is placed on the front of the anode for each of the intersection points of the matrix that are in the drive condition. With an appropriate matrix drive in terms of chronological sequence and strength, characters and images can be displayed on the luminescent screen. A further discussion of the structure and operation of the discharge device is given in the above two U.S. Patents whose disclosures are hereby incorporated.

A flat gas discharge display element with a plurality of gas discharge cells which are arranged matrix-like, is known from U.S. Pat. No. 4,066,929, which is based on the same foreign application as German O.S. 26 01 925. In this device, a grid electrode is arranged in each cell between the anode and the cathode. The grid electrode contains at least one aperture whose edge profile is congruent with the projection of the cathode.

In known gas discharge display devices, high energy electrons generate a disruptive background brightness on the picture screen. This brightness is due to the fact that the high energy electrons are not electrically blocked at the control hole openings of the control plate. Light from the gas discharge space will also strike the picture screen through the control hole openings in the control plate to generate a background brightness.

The smaller the gas pressure in the gas discharge display device; the more apparent are these two disruptive effects. On the other hand, the puncture strength in the post acceleration space of the gas discharge display device becomes all the greater with the lower gas pressure.

In a gas discharge space of a flat gas discharge display device, metal ions will sputter off from the cathode and precipitate onto the rows or parallel extending conductors on the control plate. This precipitation of metal atoms will have a negative effect or influence on the insulation resistance between the lines.

SUMMARY OF THE INVENTION

The present invention is directed to eliminating the disadvantages that are present in gas discharge display devices. In order to achieve this object, the present invention provides an improvement for a gas discharge display device having a front and back plate sealed together to form a gas filled chamber or cavity, a control plate placed between the front and back plate to subdivide the gas filled cavity into a gas discharge space adjacent the back plate and a post acceleration space adjacent the front plate, said control plate having electrodes as parallel extending row conductors on one surface and parallel extending column conductors on the other surface, said row and column conductors forming a matrix of intersecting points with the plate having a perforation of each of said points, said front plate being provided with a luminescent screen having an anode layer and the back plate having one or more cathodes mutually insulated from one another. The improvement is the provision of a lamellar lattice composed of a plurality of overlapping strips being arranged in the gas discharge space between the back plate and the control plate so that a direct path between a cathode to the control plate is obstructed.

The inventive gas discharge display device has the advantage that the strip forming the lattice are arranged to interlace between the cathode and the control plate in the gas discharge plate of the device. The strips are arranged to be mutually offset and form a lamellar lattice so that a direct path between each cathode and the control plate is blocked or obstructed. High speed electrons, light and metal atoms are therefore intercepted by the strips of the lattice.

The lamellar lattice is preferably composed of strips having a width in the range 1–20 mm which are formed of a material which will conduct electrical currents such as aluminum. It is also advantageous to electrically connect the individual strips of the lamellar lattice to one another so that the individual parts of the lattice can be stamped from an aluminum sheet.

Further advantages of the device are the applying of a material with an increased secondary electron emission on a surface of each of the strips facing the cathode.

Other advantages are obtained by arranging the strips in a plurality of individual planes which extend parallel to each other, and have a louver configuration. Another embodiment of the invention arranges the strips in two planes, whose normal are perpendicular to the plane of the control plate, with the strips of one plane overlapping the spacing between the strips of the other plane. When the lattice is arranged with strips in two planes, each of the strips in each plane are provided with means for electrically interconnecting those strips so that different potentials may be applied to each of the strips of the two planes with a more positive control potential being on the strips of the plane closest to the control plate. The plurality of overlapping strips may have a lateral extension into the area of the transmission apertures which lies in the range of 0.1 to 5 mm and the spacing between individual strips in each of the planes may be in a range of 1 to 10 mm.

In one embodiment, each of the strips has a substantially U-shaped channel cross-section with the edge portions of the strip in each plane facing the edge portions of the strips in the other plane and extending substantially perpendicular to the plane of the control plate.

The display device according to the present invention can also have the gas selected from a group of gases consisting of neon, xenon, hydrogen, nitrogen, helium and mixtures of neon, xenon, hydrogen, nitrogen and helium.

Since the lamellar lattice is to screen the plasma of the gas discharge from the row lines of the control plates, it is expedient to not employ the entire cathode current but rather to only direct a part of it to the row of lines. Due to the great reduction of the dark current from for example a few 100 $\mu$A to a value of approximately 1 $\mu$A for the nonselected row lines, a reduction of the background brightness of the inventive gas discharge display is achieved.

DESCRIPTION OF THE PREFERRED EMBODIMENTS

Figure 1:
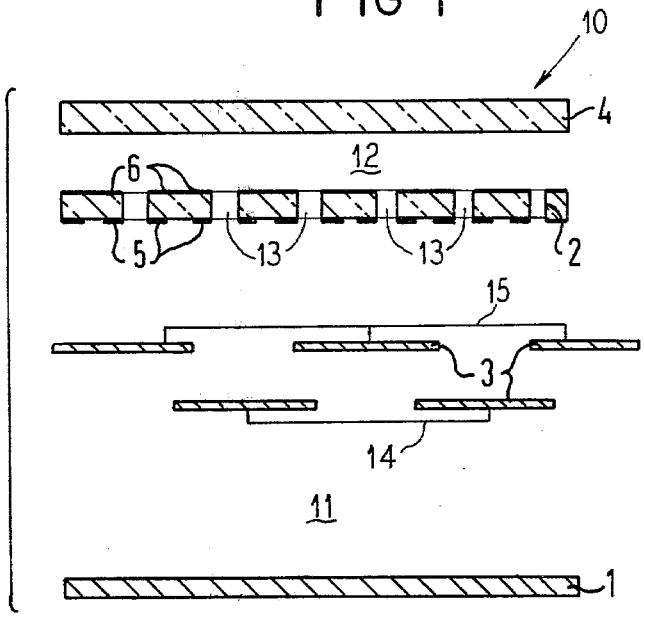
FIG. 1 is a partial cross-sectional view of a display device in accordance with the present invention.

The principles of the present invention are particularly useful in a gas discharge display device generally indicated at 10 in FIG. 1. The display device 10 consists of an envelope having a back wall or plate 1 with at least one cathode, which is sealed by conventional means (not illustrated) to a front wall or plate 4 having a picture screen formed by a fluorescent layer and having an anode. A control plate 2 is interposed between the front plate 4 and the back plate 1 and the control plate 4 subdivides the cavity between the front and back plates into a gas discharge space 11, which is adjacent the back plate 1 and the cathodes thereon and a post acceleration space 12 which is defined by the control plate 2 and the front plate 4. As is conventional, the control plate 2 has a plurality of parallel extending line or row conductors 5 on the surface facing the cathode on the back plate 1 and a plurality of column conductors 6 which extend parallel to each other and face the anode on the front plate 4. The column conductors 6 extend perpendicular to the direction of the row conductors 5 so that a matrix of intersecting points are formed which points are provided with perforations such as 13.

The improvement in the device 10 is the provision of a lamellar lattice 3 which is composed of a plurality of parallel extending strips. As illustrated in FIG. 1, the strips lie in a first and second plane with the strips of the second plane adjacent the control plate 5 overlying the spacing between the strips in the plane closest to the back plate 1. As mentioned hereinabove, each of the strips are preferably made of an electrical conducting material, such a aluminum, and may be interconnected at their edges by electrical means with the strip in the plane closest to the back plate 1 being connected by means schematically illustrated by a line 14 and the strips in the back plane adjacent the control plate 2 being interconnected electrically by means schematically illustrated by the line 15.

The gas discharge dipaly device 10 of FIG. 1 can have the following parameters. A spacing between the cathode on the back plate 1 and the lattice 3 formed of the strips being approximately 15 mm. The width of each strip of the lattice being 2.2 mm, and the width of the spacing or interval between each of the strips being equal to 2.0 mm. The spacing between the control plate 2 and the lattice 3 formed by the strips being approximately 5 mm, and the height of the thickness of the post acceleration space between the control plate 2 and the front plate 4 being 1 mm. The filling gas is xenon with a pressure $\leqq 0.1$ mbar. A conducting voltage, which is applied to the cathode, which is aluminum, equals 315 volts with a control voltage on the strips of the lattice being equal to 0 volts. The activated row conductors 5 will have a +10 volts while the row conductors 5 which are to be in a blocking state will have a voltage of between −4 and −30 volts. Column conductors 6, which are for illuminated points, will have a voltage of +10 volts while column conductors 6, which are to be in a blocking state will have a 0 voltage. The post acceleration voltage will equal approximately 3 kV, the row sweep will equal 300 rows/20 ms and the picture point grid of the cell will be $0.32 \times 0.64$ mm.

Figure 2:
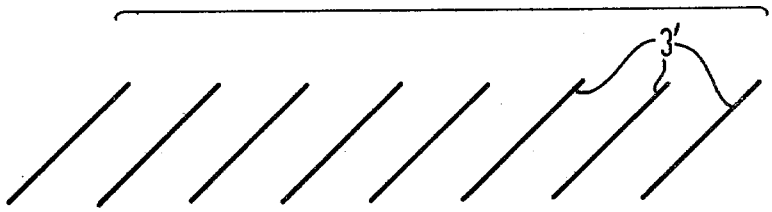
FIG. 2 is a partial cross-sectional view of an embodiment of a lamellar lattice useable in the device of FIG. 1.
Figure 3:
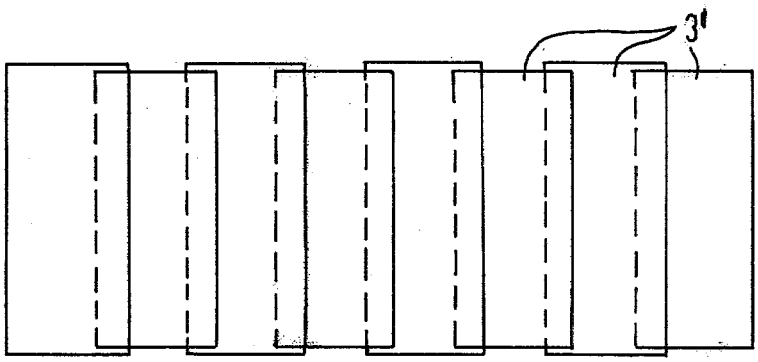
FIG. 3 is a plan view of the lattice of FIG. 2.

In FIGS. 2 and 3, an embodiment of the lattice 3' is illustrated. The lattice 3' comprises a plurality of strips, which are arranged in overlapping separate parallel planes in a louver fashion.

Figure 4:
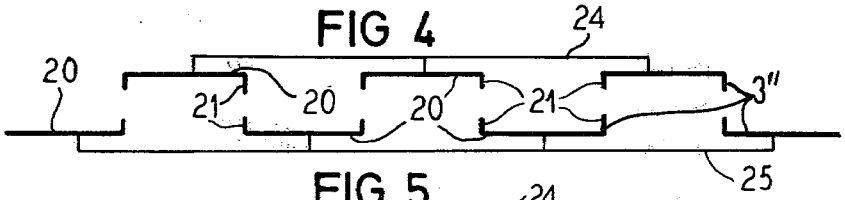
FIG. 4 is a partial cross-section of another embodiment of the lattice useable in accordance with the present invention.
Figure 5:
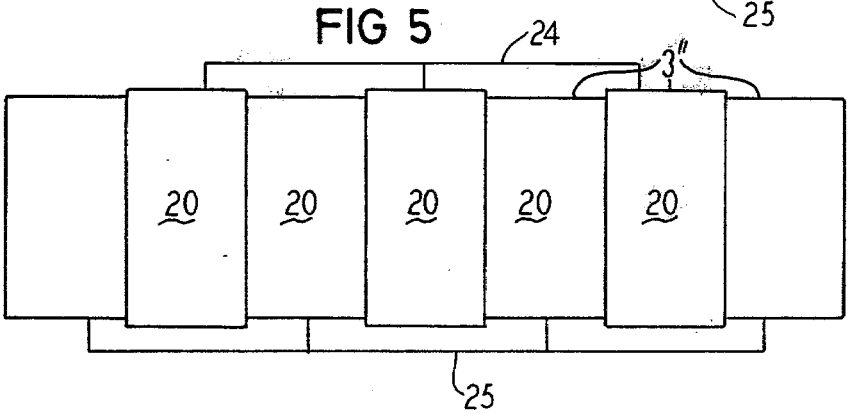
FIG. 5 is a plan view of the lattice of FIG. 4.

In FIGS. 4 and 5, another embodiment for the lattice is indicated at 3''. The lattice of 3'' is formed of two planes containing individual strips 20. The strips 20 have a channel-shaped cross-section with edge portions 21, which are arranged to extend facing edge portions of the strips in the adjacent plane. As illustrated, each of the strips 20 in one plane are electrically interconnected by means as illustrated schematically by the line 24 while the strips in the second plane are electrically interconnected by means schematically illustrated by the line 25.

It is characteristic of all the sample embodiments, that a straight line connection or path between a cathode on the rear plate 1, and the control plate 2 is obstructed by means of the offset arrangement of the successive lamellar lattice 3, 3′, or 3″ which are each composed of strips of different configurations and arrangements. Thus, particles flying from the cathode on the back plate 1 toward the control plate 2 are forced to take a bent or tortuous path which leads to an impediment of the motion of particles such as for example electron, photons, or metal ions. By means of a suitable control voltage applied to the row conductors 5 of the control plate 2 or to the individual strips of the lattice 3, 3′, or 3″ can be seen that part of the electrons proceeding from the cathodes on the back plate will pass through the lamellar lattice structure 3 and reach the row conductors 5 which are selected.

Although various minor modifications may be suggested by those versed in the art, it should be understood that I wish to embody within the scope of the patent granted hereon, all such modifications as reasonably and properly come within the scope of my contribution to the art.

I claim:

1. In a gas discharge display device having a front and back plate sealed together to form a gas filled cavity, a control plate placed between the front and back plate to subdivide the gas filled cavity into a gas discharge space adjacent the back plate and a post acceleration space adjacent the front plate, said control plate having electrodes as parallel extending row conductors on one surface and parallel extending column conductors on the other surface, said row and column conductors forming a matrix of intersecting points with the plate having a perforation at each of said points, said front plate being provided with a luminescent screen having an anode layer and said back plate having more than one cathode mutually insulated from one another, the improvement comprises a lamellar lattice composed of a plurality of overlapping strips being arranged in the gas discharge space between the cathodes of the back plate and the control plate so that a direct path between the cathode to the control plate is obstructed.

2. In a gas discharge display device according to claim 1, wherein each of the strips of the lamellar lattice have a width in a range of 1–20 mm and consists of an electrically conductive material.

3. In a gas discharge display device according to claim 1, which includes means electrically interconnecting each of the strips of the lamellar lattice.

4. In a gas discharge display device according to claim 1, wherein the strips consists of aluminum.

5. In a gas discharge display device according to claim 1, wherein a layer of material with an increased secondary electron emission is applied to a surface of each of the strips of the lamellar lattice facing the cathode.

6. In a gas discharge display device according to claim 1, wherein the strips of the lattice are arranged in different planes extending parallel to one another with the strips of each plane overlapping adjacent strips when taken in the direction extending perpendicular to the plane of the control plate.

7. In a gas discharge display device according to claim 1, wherein the lattice has a plurality of strips arranged in one plane with spacings therebetween, each of said strips having a normal extending perpendicular to the plane of the control plate.

8. In a gas discharge display device according to claim 7, wherein the lattice includes a second group of strips arranged in a second plane extending substantially parallel to the one plane with the strips being mutually offset relative to the strips of the one plane to cover the spacings between the strips of said one plane.

9. In a gas discharge display device according to claim 8, wherein the lateral overlap of the strips in the two planes in the range of 0.1–5 mm.

10. In a gas discharge display device according to claim 8, wherein the spacing between various strips of each plane lie in the interval in a range of 1–10 mm.

11. In a gas discharge display device according to claim 8, which includes means for electrically interconnecting all of the strips in the one plane and separate means for electrically interconnecting all of the strips in the second plane so that different control potentials can be applied on each group of strips with the strips of the plane adjacent the control plate having a more positive control potential than the strips in the plane closer to the cathodes.

12. In a gas discharge display device according to claim 1, which includes a second lamellar lattice interposed between the first mentioned lattice and the control plate, said second lattice being offset from the lattice which obstructs the direct path between the control plate and the cathodes, the second lattice comprising a strip grid having a width smaller than the width of the interspacing between the strips of the first mentioned lattice.

13. In a gas discharge display device according to claim 1, wherein the gas is selected from a group of gases consisting of neon, xenon, hydrogen, nitrogen, helium and mixtures of neon, xenon, hydrogen, nitrogen and helium.

14. In a gas discharge device according to claim 1, wherein the lattice comprises a pair of planes containing strips, each of the strips in said lattice having a channel U-shaped configuration with the edge portions of each channel extending towards the edge portions of the channels in the other plane, the portion between the edge portions being substantially in the planes extending parallel to the control panel.

* * * * *